US011193297B2

(12) United States Patent
Zucaro et al.

(10) Patent No.: US 11,193,297 B2
(45) Date of Patent: Dec. 7, 2021

(54) POLE, UMBRELLA MAST, AND THE LIKE, ANCHOR AND METHOD OF USE

(71) Applicants: Maria Patrizia Zucaro, Westport, CT (US); Ann Marie Melaragno, Norwalk, CT (US)

(72) Inventors: Maria Patrizia Zucaro, Westport, CT (US); Ann Marie Melaragno, Norwalk, CT (US)

( * ) Notice: Subject to any disclaimer, the term of this patent is extended or adjusted under 35 U.S.C. 154(b) by 19 days.

(21) Appl. No.: 16/669,517

(22) Filed: Oct. 31, 2019

(65) Prior Publication Data

US 2020/0141149 A1 May 7, 2020

Related U.S. Application Data

(60) Provisional application No. 62/754,546, filed on Nov. 1, 2018.

(51) Int. Cl.
*E04H 12/22* (2006.01)
*A45B 23/00* (2006.01)

(52) U.S. Cl.
CPC ..... *E04H 12/2215* (2013.01); *A45B 23/00* (2013.01); *A45B 2023/0012* (2013.01)

(58) Field of Classification Search
CPC ..... E04H 12/2246; A45B 2023/0012
USPC ..... 248/519, 526, 530, 123.2, 406.2, 182.1, 248/910, 545
See application file for complete search history.

(56) References Cited

U.S. PATENT DOCUMENTS

| | | | | |
|---|---|---|---|---|
| 2,554,887 | A | 5/1951 | Tricarico | |
| 2,970,701 | A * | 2/1961 | Fetter | A47B 11/00 211/78 |
| 5,123,623 | A | 6/1992 | McNamara | |
| 5,687,946 | A | 11/1997 | Cho | |
| 6,412,748 | B1 | 7/2002 | Girard | |
| 6,908,067 | B2 | 6/2005 | Clasen | |
| 6,953,180 | B1 | 10/2005 | Ruvalcaba et al. | |
| 7,520,485 | B1 * | 4/2009 | Giannetto | A01K 97/10 173/91 |
| D605,872 | S | 12/2009 | Gharst | |
| 2003/0025056 | A1 * | 2/2003 | Atchley | B25B 9/00 248/304 |
| 2006/0006306 | A1 * | 1/2006 | Wadsworth | E02D 27/42 248/511 |
| 2008/0017226 | A1 * | 1/2008 | Nobert | E04H 12/2269 135/16 |
| 2008/0230674 | A1 * | 9/2008 | Schroeder | E04H 12/2292 248/545 |
| 2010/0200724 | A1 | 8/2010 | Kukuk | |

(Continued)

OTHER PUBLICATIONS

Ammsun Beach Umbrella Sand Anchor Amazon <https://www.amazon.com/AMMSUN-Beach-Umbrella-Anchor-Holder/dp/B01GRJTFK8/ref=sr_1_4?dchild=1&keywords=ammsun+sand+anchor&qid=1586460253&sr=8-4>, retrieved on Apr. 9, 2020.

*Primary Examiner* — Muhammad Ijaz

(57) ABSTRACT

A device and method for anchoring a device, such as a mast or pole, including a base having a space or opening for inserting a mast or pole and a wedge having a pointed end or a rounded end and a beveled edge, wherein the wedge is attached perpendicularly to the base. A method of installation of the device includes placing the device on a surface, (Continued)

exerting a downward force on the base, and plunging the wedge into the surface.

20 Claims, 7 Drawing Sheets

(56) References Cited

U.S. PATENT DOCUMENTS

| | | | | |
|---|---|---|---|---|
| 2013/0161474 | A1* | 6/2013 | May | E02D 27/42 248/530 |
| 2017/0089509 | A1 | 3/2017 | Bailey | |

* cited by examiner

POLE, UMBRELLA MAST, AND THE LIKE, ANCHOR AND METHOD OF USE

CROSS REFERENCE TO RELATED APPLICATIONS

This application claims priority to U.S. Provisional Application No. 62/754,546 entitled UMBRELLA ANCHOR AND METHOD OF USE filed Nov. 1, 2018. The contents of this application are herein incorporated by reference in their entirety.

FIELD OF THE INVENTION

The present invention relates to an anchor device and a method of use thereof. The anchor is configured to easily position and hold a beach umbrella mast, pole, tent pole, or a similar object in a surface, such as sand on the beach, or soil. The pole anchor can be used at the beach or other environments to easily anchor an umbrella mast or other articles that need to be secured in position.

BACKGROUND OF THE INVENTION

Going to the beach is very common in the summer and even all year round in areas with warmer climates. A day in the sun provides entertainment for the kids and much needed vitamin D. But spending too long in the sun can be very harmful, resulting in extreme burns and even skin cancer. To provide a refuge from the hot sun, many beach goers bring large beach umbrellas to provide shade for themselves and/or their children. Beach umbrellas are notorious for flying away due to the increased wind turbulence coming off the water. Relatedly, poles or posts used for securing a camping or military type tents, and used for foldable overhead tents commonly used at conventions, picnics, retreats, and the like. To combat the problem of dislodged poles and air-borne umbrellas and tents, there are a number of solutions for anchoring beach umbrella masts and other securing poles into the beach to prevent them from disconnecting from the ground. Some of these solutions attempt to use a corkscrew like anchor, but these solutions fail to meet the needs of the industry because such corkscrew anchors require considerable strength and endurance to fix in place such umbrella masts, and other poles in the sand. Other solutions attempt to secure beach umbrella masts to other permanent structures, but these solutions are similarly unable to meet the needs of the industry because stable structures are not always available to all beach goers, campers, and the like.

Existing known systems include U.S. Pat. Nos. 2,554,887, 5,123,623, 5,687,946, 6,412,748, 6,908,067, 6,953,180, US 20100200724A1, US 20170089509A1 and US D605872.

It is desired to provide a method and system that solves the disadvantages in existing systems and to provide a solution to the problem of securing a pole or mast to a surface in such manner as to mitigate or prevent the pole or mast from being dislodged and possibly launched away due to the wind.

SUMMARY OF THE INVENTION

It is an object of the present invention to provide a device and associated method that can anchor an umbrella mast or pole, such as a beach umbrella mast or pole. It is an object of the present invention to provide a device and associated method that can anchor an mast or pole whereby the installation of device is simple and does not require a large amount of effort or manual strength of a user.

Furthermore, it is an object of the present invention to provide a device that is user friendly to install and use regardless of the user's strength level or endurance.

It is an object of the present invention to provide a device that is light weight yet can withstand dynamic weather and beach conditions; especially high gusts and/or sustained winds.

These and other objects of the invention are achieved by a disclosed mast or pole anchor and associated method of use that advantageously fill these needs and addresses the aforementioned deficiencies. In certain embodiments, the mast or pole anchor may be installed using a user's own body weight.

In certain embodiments, the anchor is made up of the following components: a base and a wedge, the base having a space or opening or opening for inserting a mast or pole and/or a beach umbrella. These components are connected perpendicularly to one another. Further embodiments include a method for installing the anchor which include the steps of placing the anchor on a surface, exerting a downward force onto the base, and causing the wedge to be plunged into the surface.

In certain embodiments, the user can use a circular motion with the downward force in order to cause the wedge to be plunged into the surface.

In certain embodiments, the anchor may also have one or more of the following: a pointed end, a rounded end, a beveled edge, tapered edges, rounded edges, a taper from base to point, a frame, a base plate, flanged edges, a grommet, eyelet, and an attached pole. The anchor may be made of metal, steel, aluminum, plastic, silicon, rubber, any other consumer product grade material, industrial materials, or a combination thereof. Similarly, the associated method may also include one or more of the following steps: exerting a downward force using one's foot, using one's body weight, inserting a pole into the opening on the base, and positioning one's leg and/or foot off center.

In an embodiment of the invention, the anchor is made up of the following components: a base made of a base plate and a frame, the base plate having a space or opening or opening for inserting a pole, the space or opening or opening having a grommet to securely fit the pole, the frame having flanged edges supporting the structure in position, a wedge having a pointed end, a beveled edge, and a taper toward the pointed end, the wedge being perpendicularly connected to the base.

It should further be noted that: the anchor can be made using metal, steel, aluminum, plastic, silicon, rubber, or a combination thereof. While the parts may be connected to one another via welding, glue or other means related to the chosen material, the anchor can also be produced as one solid piece such as but not limited to injection molding, thermoform, or casting.

Further, the anchor need not be completely solid, there may be benefits for having through holes and space or openings in the wedge and base so as to allow sand, dirt, water, or debris to pass through. Benefits include but are not limited to easier installation in the ground and allowing for the ground material to be positioned in and around the anchor as to additionally secure the anchor in position.

Other objects of the invention are achieved by providing a method associated with the disclosed device includes the following steps: (1) placing the anchor on a surface which may be composed of but is not limited to sand, dirt, soil, rock, pebbles, grit, or a combination thereof; (2) exerting a downward force onto the base, using one's bodyweight by placing one's foot onto the base and shifting one's center of gravity so as to increase the weight on the base; and (3) plunging the wedge into the surface. In certain embodiments, the user can use a circular motion by way of the attached pole with the downward force in order to cause the wedge to be plunged into the surface.

It should further be noted that: one may install the anchor while there is a mast or pole already inserted in the space or opening or opening by placing one's foot off center. In an alternate embodiment, the wedge is oriented substantially off center to shift the center of gravity of the anchor allowing for easier installation and reducing the need to position one's foot directly center on the base.

In certain embodiments, an anchor for anchoring a beach umbrella has a base having a space or opening for inserting a pole, a wedge having a pointed end and a beveled edge, wherein the wedge is attached perpendicularly to the base.

In certain embodiments, the base further includes a frame having flanged edges.

In certain embodiments the base further includes a base plate wherein the space or opening for inserting a mast or pole is located on the base plate.

In certain embodiments, the base plate does not completely fill the frame.

In certain embodiments, the space or opening for inserting a mast or pole further includes a grommet for securely fitting the mast or pole.

In certain embodiments, the wedge is composed of two tapered edges converging substantially to a point.

In certain embodiments, the anchor is made of metal, steel, aluminum, plastic, silicon, rubber, stone, wood, similar materials or a combination thereof.

In certain embodiments, the wedge is positioned off center to allow a downward force to be exerted onto the wedge while a mast or pole is inserted or attached in the space or opening on the base.

In certain embodiments, the anchor has gaps to allow flow of sand, water or other debris to pass through.

Other objects of the invention are achieved by providing a method for installing a beach umbrella mast or pole anchor including placing the anchor on a surface, exerting a downward force onto the base, and plunging the wedge into the surface. In certain embodiments, the user can use a circular motion with the downward force in order to cause the wedge to be plunged into the surface.

In certain embodiments the surface is sand, dirt, soil, rocks, pebbles, grit or a combination thereof.

In certain embodiments the downward force is done by using body weight.

In certain embodiments exerting the downward force is done by using one's foot.

In certain embodiments exerting the downward force on the base is accomplished by placing one's foot on the base and shifting one's center of gravity so as to increase the weight on the base.

In certain embodiments the method includes positioning one's foot off center so as to avoid the space or opening for the mast or pole. In certain embodiments, the footing is off center so as to maintain stability of the anchor.

In certain embodiments the method includes inserting an umbrella mast or pole into the space or opening.

In certain embodiments a pole is permanently attached to the anchor.

Advantages of the anchor and method include (1) easy installation; and (2) a way to secure one's beach umbrella mast or pole without the need for using permanent structures. Similarly, the associated method is unique in that it: (1) allows for installing the anchor simply by pressing firmly with one's foot. Similarly, the disclosed method is unique when compared with other known processes and solutions in that it: (1) does not require excessive force; (2) excessive upper body strength and (3) is quicker and less time consuming than existing methods.

The disclosed embodiments are unique in that they are structurally different from other known devices or solutions. More specifically, the device is unique due to the presence of: (1) a base configured to allow for installation simply by exerting a downward force with one's foot; (2) a wedge oriented in a fashion as to easily penetrate the ground; and (3) gaps in the construction as to allow debris to easily pass through allowing for the wedge to easily be inserted into the ground, and then be secured by the weight of the debris.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

In the following description, numerous details are set forth for the purpose of explanation. However, one of ordinary skill in the art will realize that the invention may be practiced without the use of these specific details.

In certain embodiments of the invention, an anchor for improved temporary anchoring of a beach umbrella includes a base including a frame having flanged edges; a wedge having a pointed end and a beveled edge affixed to the base; a base plate affixed to the base having an opening for inserting a beach umbrella therethrough; wherein the wedge is inserted and secured into a semi-solid surface; and wherein the beach umbrella is inserted through the base plate opening and secured into the semi-solid surface; thus providing additional constructive surface area communication and tension between the semi-solid surface and beach umbrella.

In certain embodiments of the invention, the device includes a base and a wedge, which, generally speaking, are configured as follows: the base and the wedge are attached perpendicularly to one another, the base having a space or opening for a mast or pole to be inserted therein. With respect to the associated method, in order to carry out the method, the following steps are followed: placing the device on the ground, exerting a downward force on the base to plunge the wedge into the ground. Ultimately, at the conclusion of these steps, a substantial portion of the anchor is underground providing a grounded support for a mast or pole such as a beach umbrella mast or pole. In certain embodiments, the user can use a circular motion with the downward force in order to cause the wedge to be plunged into the surface. In certain embodiments, the entire anchor is below the sand and typical sand is pushed over the top of the anchor to submerge the anchor and hold it in place.

Figure 1:
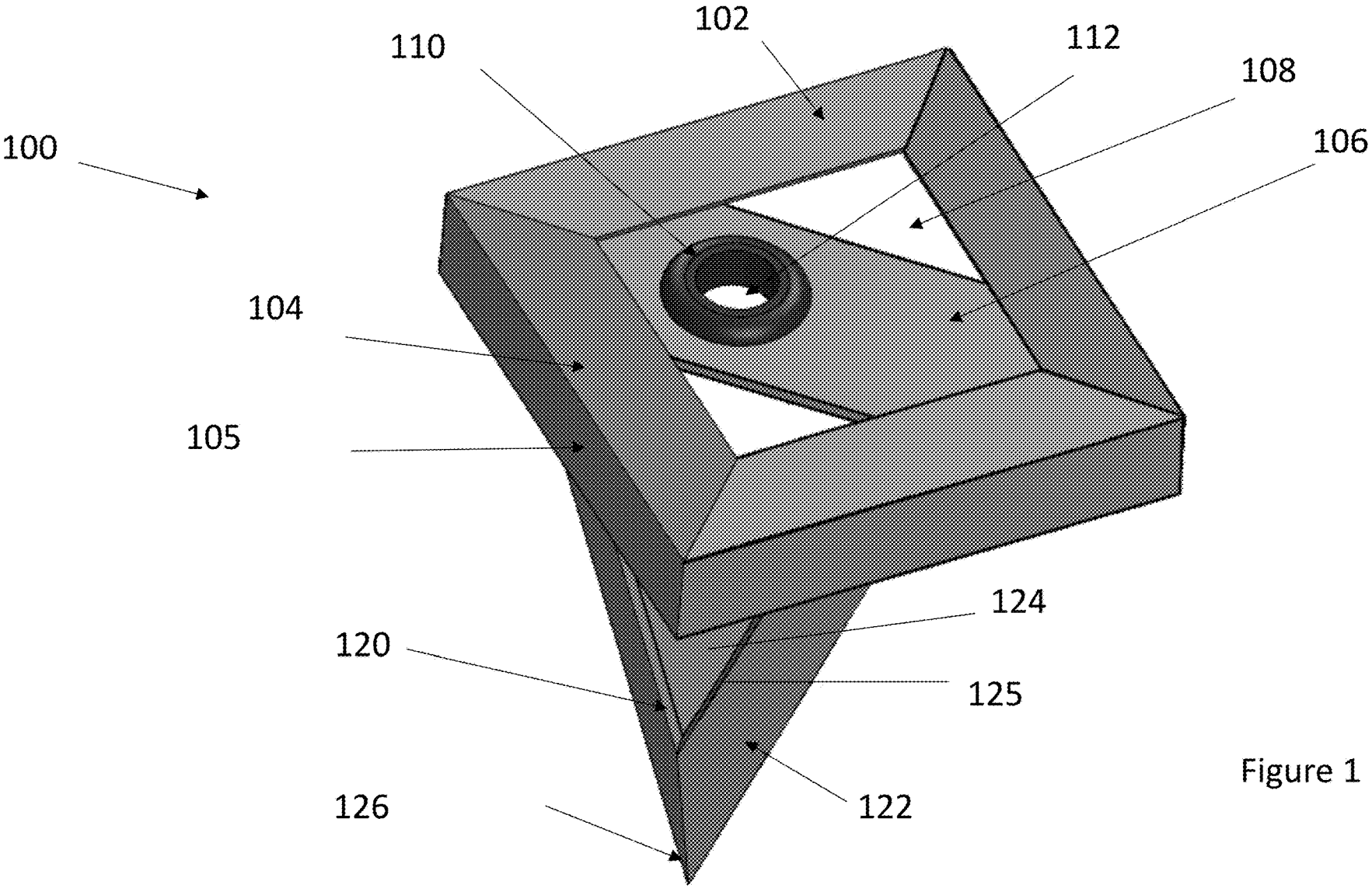
FIG. 1 is a perspective view of an embodiment of the present inventive device.

Referring to the figures, FIG. 1 is a perspective view of an embodiment of the present inventive anchor. The mast or pole anchor 100 has a base 102 and a wedge 120. The base 102 is made of a frame 104 and a plate 106. The frame 104 in this instance has four edge pieces, however, can vary in the number of edge pieces or be one continuous piece. The base is not limited to a specific number of edges, nor requires a minimum number of edges and can be circular or substantially circular without departing from the scope of the invention. The frame 104 can have flanged edges 105 which may assist in retaining the position of the anchor as it may penetrate the ground in addition to the wedge, providing additional lateral stability. The plate 106 in this particular instance is narrower than the total width of the frame 104, however, it can be wider and oriented in a direction in order to fill the gaps 108 or vary in shape to form specific gaps. The base is not limited to a particular frame and plate combination, nor does it require the frame and the plate to be separate parts. The gaps 108 may assist in allowing trapped air or debris to escape which may ease installation of the anchor 100. The plate 106 has a space or opening 112, substantially off center, for an umbrella mast or pole or other cylindrical objects that a user may find a need to orient in a specific direction while providing stability, which can include but is not limited to a flag pole or a tent pole. The space or opening 112 need not be in any particular location on the plate, however, specific locations may provide additional benefits as will be shown below. A grommet 110 can be removably attached within the space or opening 112 for better fitting an inserted mast or pole and providing traction resisting upward movement of the mast or pole. In certain embodiments, multiple size masts or poles are used with the anchor.

The wedge 120 is attached on the bottom of the base 102. The wedge may be pointed as shown and have a beveled edge 122. The beveled edge 122 may be tapered in two directions. The first taper may start substantially from the center of the wedge or the inner side of the beveled edge outward to the edges of the bevel. The second taper may start from the side of the wedge attached to the base (not shown) toward the point 126. A taper is referring to a portion which gradually changes in width, starting from a larger width toward a narrower width, or even to a point or substantially sharp edge or rounded edge. It is noted, however, that a taper is not a necessary part of the present invention, and the wedge need not be sharp, pointed, nor a particular shape. The center of the wedge 124 may be filled or hollow. A hollow center, like gap 108, may allow for flow of debris such as but not limited to sand or dirt to pass through, making installation of the anchor easier, and potentially more secure in the ground. The center of the wedge 124 may benefit from being filled. Some cross-section shapes may ease the installation process, for instance, the center may be fluted which may be more aerodynamic.

Figure 2:
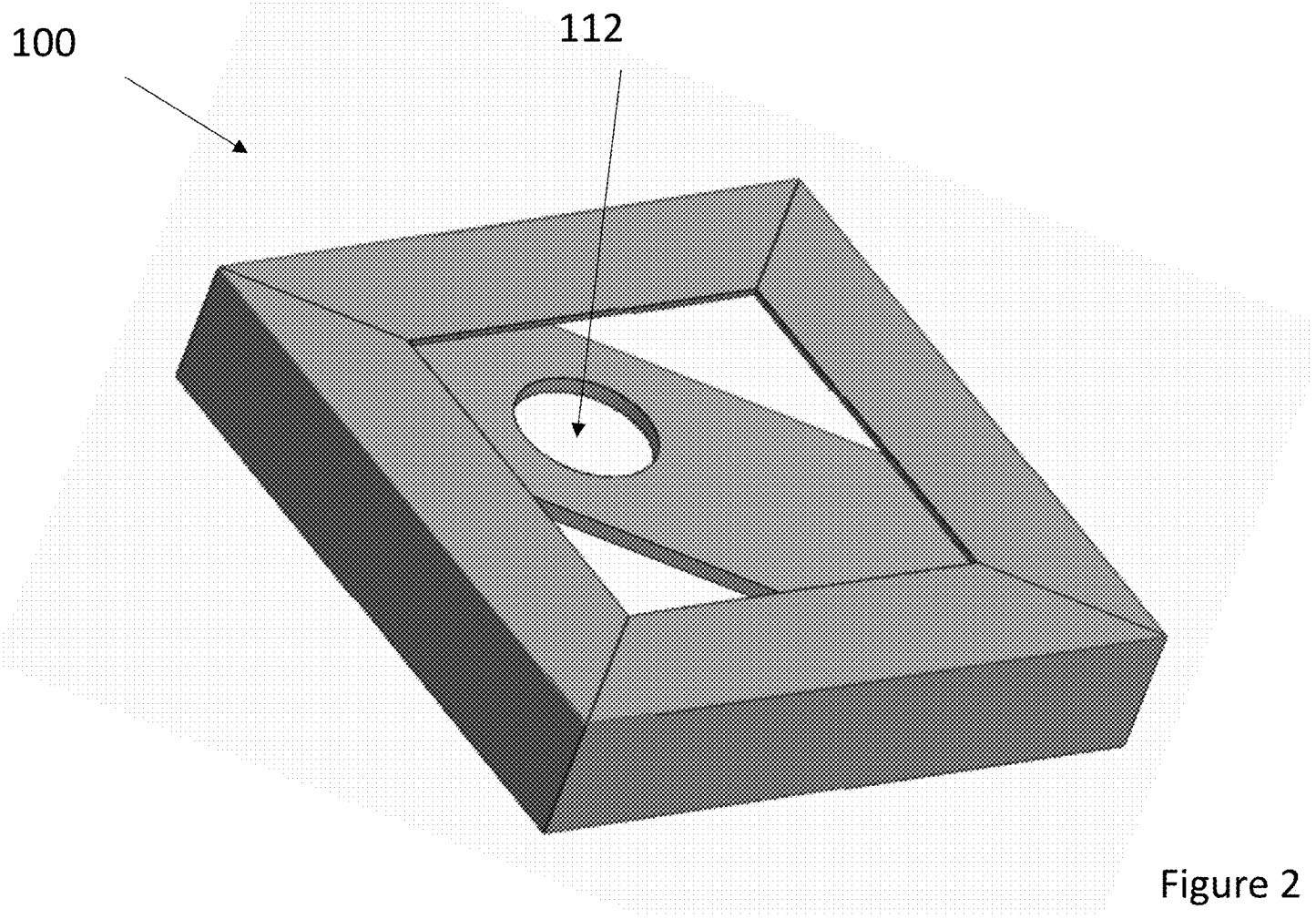
FIG. 2 is a perspective view the base of FIG. 1.

FIG. 2 is a perspective view the base 100 without the wedge and showing the space or opening 112 lacking a grommet or eyelet.

Figure 3:
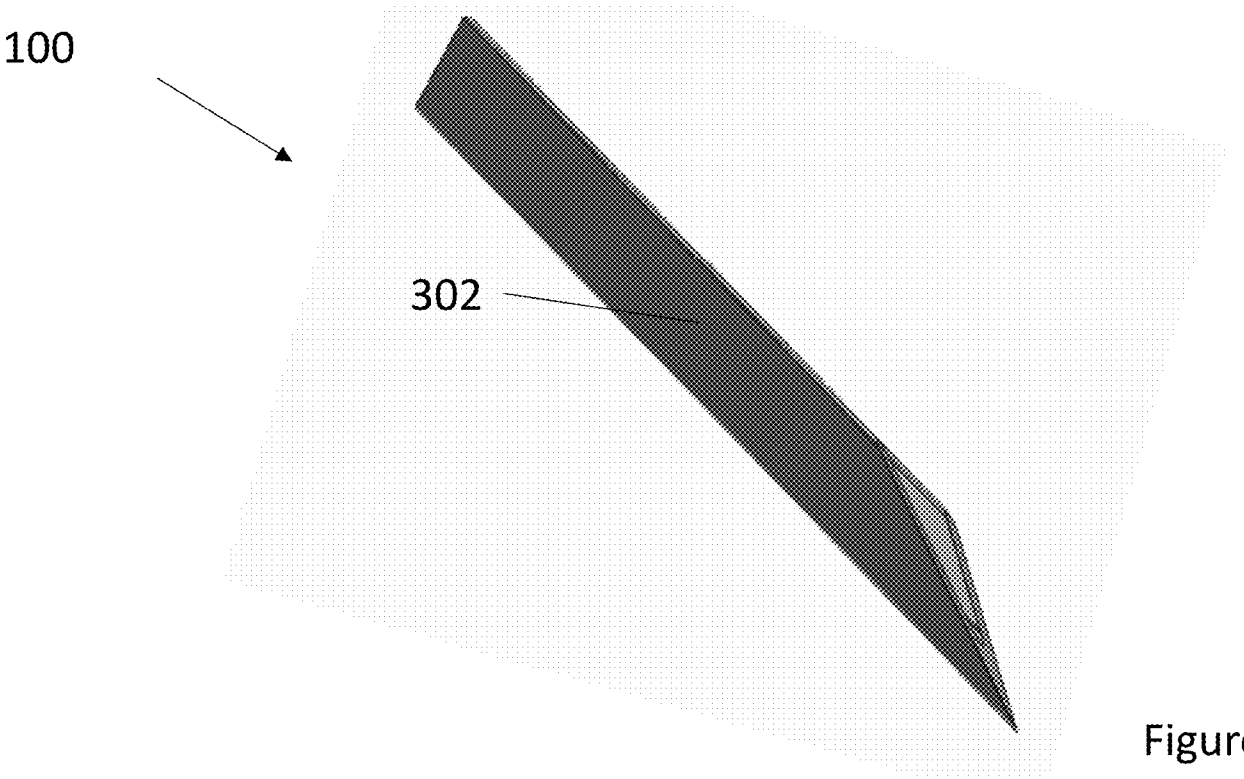
FIG. 3 is a deconstructed view of a wedge of FIG. 1.

FIG. 3 is a deconstructed view of a wedge 120. The beveled edge 302 may be constructed from multiple parts to form the wedge. FIG. 3 shows a beveled edge 302 formed from folded metal but can be solid or substantially hollow.

Figure 4:
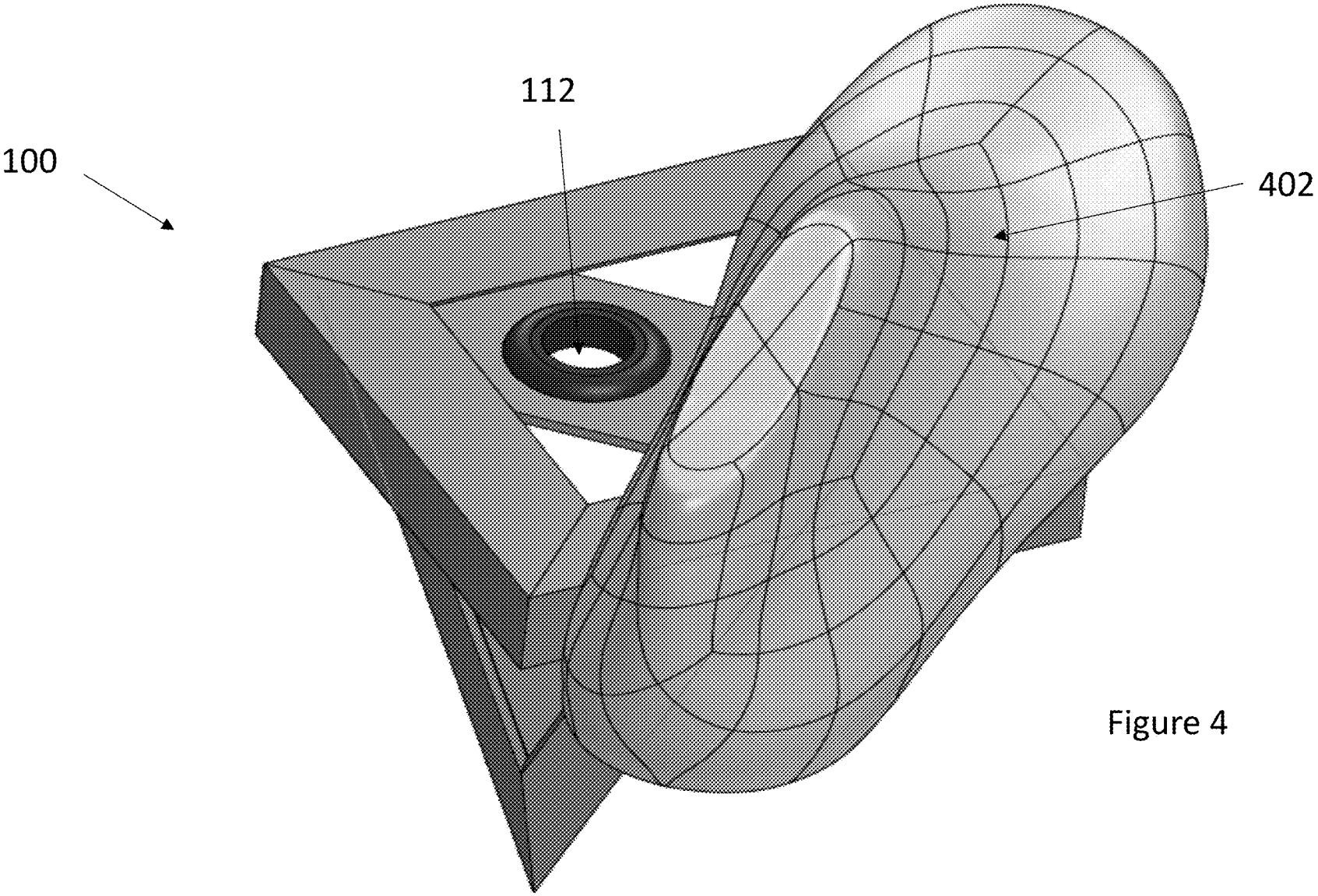
FIG. 4 is a representation of an embodiment of the associated method.
Figure 5:
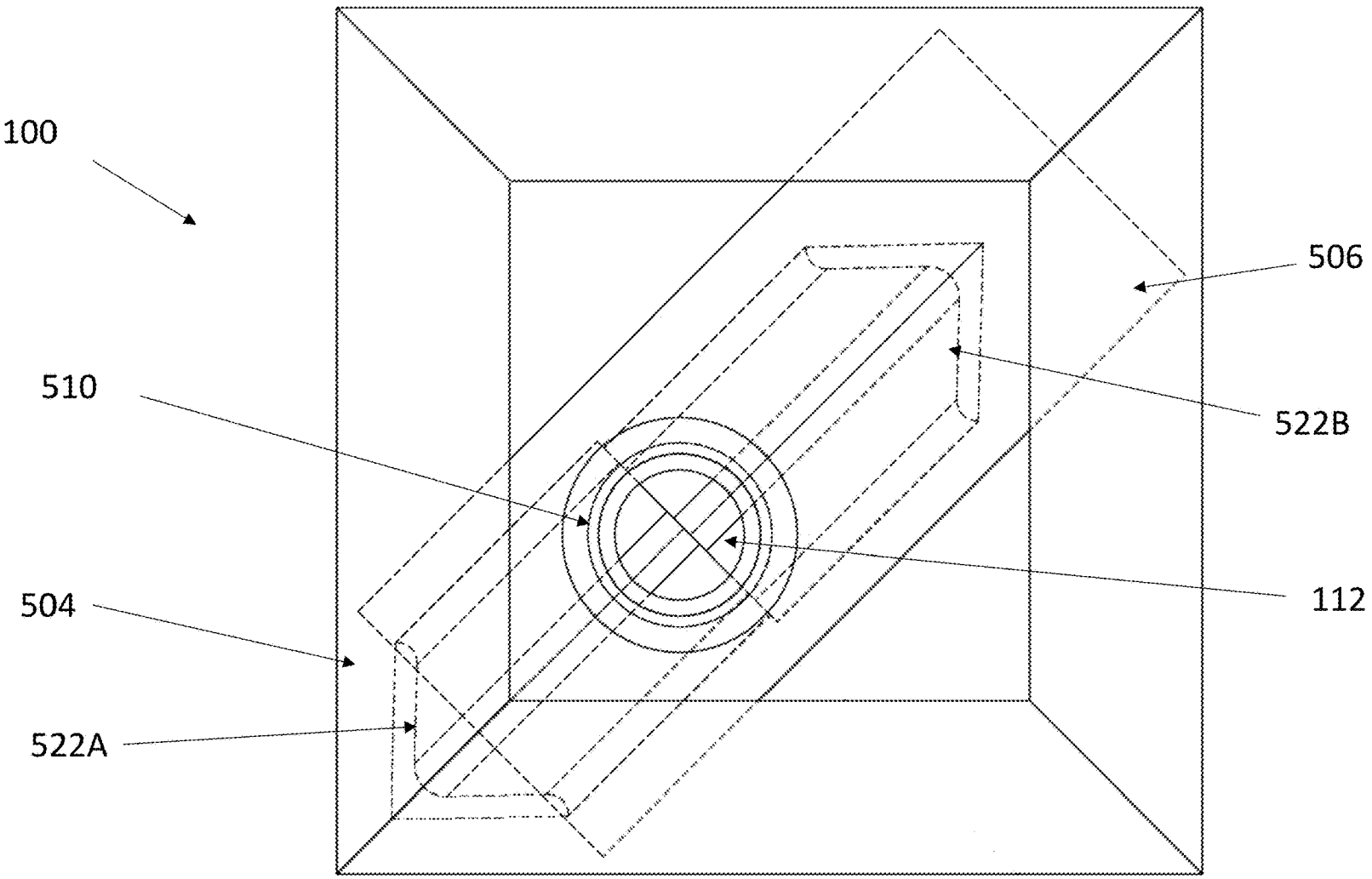
FIG. 5 is a schematic view of the base of FIG. 1.

FIG. 4 is a representation of a user's foot 402 placing downward pressure on the base to install the anchor 100 in the ground. The foot 402 can be placed anywhere on the base for application of downward force. In FIG. 4 the foot 402 is placed on one half of the base as to avoid the space or opening 112. This can be done with or without a mast or pole inserted into the space or opening, however the ability to install by pressing down on one side while avoiding the space or opening 112 allows for easier installation of the anchor 100 while there is a mast or pole in the space or opening. A user may insert the mast or pole into the space or opening before placing the anchor 100 on the ground. Then the user may press down with his/her foot on the base in an area avoiding the mast or pole. To assist in this function, the wedge may be oriented substantially underneath the point of pressure to allow the distribution of weight to align at an angle which increases the ease of installation. In certain embodiments, the user can use a circular motion with the downward force in order to cause the wedge to be plunged into the surface FIG. 5 is a top schematic view of the base 100 of another embodiment of the instant invention. In FIG. 5 the first and second beveled edge 522A and 522B are located substantially beneath the space or opening 112. The first beveled edge 522A is attached to the frame 504 of base 500. The second beveled edge 522B is attached to the plate 506. The grommet 510 and space or opening 112 are located substantially above the point where the beveled edges 522A and 522B converge to a point. The plate 506 is substantially diagonal with respect to the frame 504, but can be in any orientation, and can vary in size.

Figure 6:
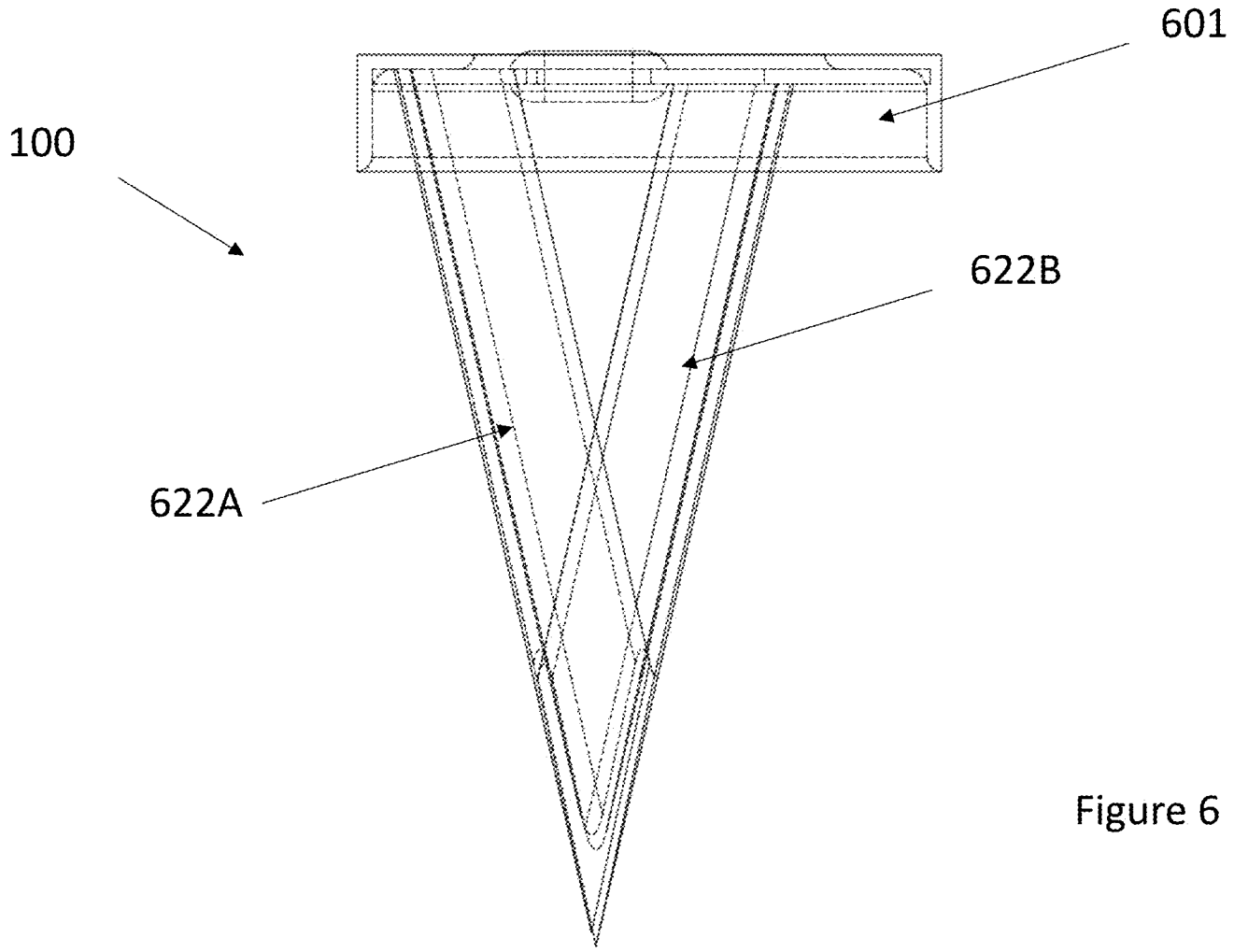
FIG. 6 is a side schematic view of the device of FIG. 1.

FIG. 6 is a side schematic view of the mast or pole anchor 100 of another embodiment. In this embodiment the first and second beveled edges 622A and 622B substantially overlap rather than converge. The first and second beveled edges 622A and 622B may also be distinct from one another in that they are individual spikes not converging to a point nor overlapping. In an embodiment such as this the first and second beveled edges 622A and 622B act as angular spikes not parallel in nature but angled so as to reduce the chance of accidental dislodgment.

Figure 7:
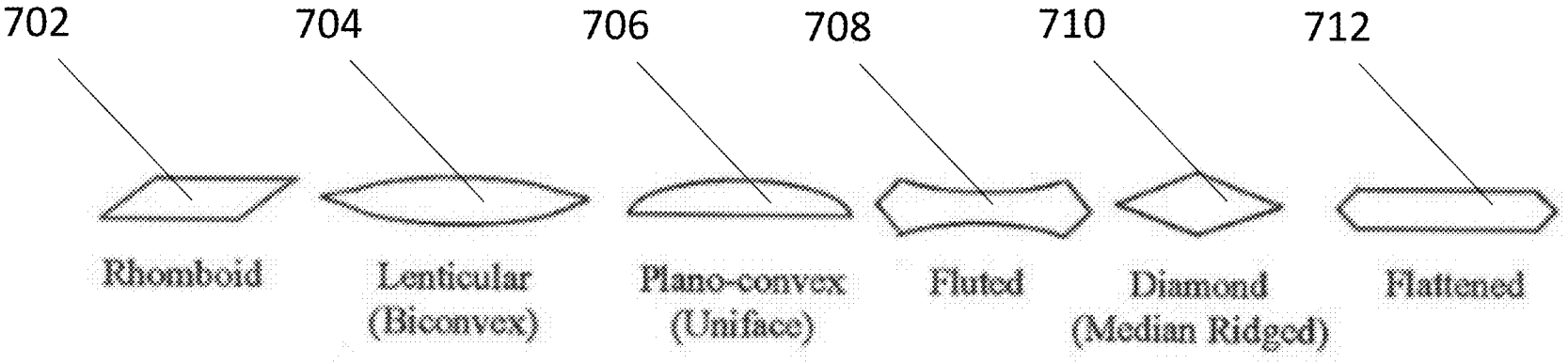
FIG. 7 are examples of wedge cross sections of embodiments of the present invention.

FIG. 7 is examples of wedge cross sections. As discussed above the center of the wedge 124 as shown in FIG. 1 may have various shapes. Examples of shapes are depicted in FIG. 7 as cross sections. The wedge in no way is limited to these exemplary cross sections and can be any shape. Shown is a Rhomboid cross section 702, a Lenticular (Biconvex) cross section 704, a Plano-convex (uniface) cross section 706, a Fluted cross section 708, a Diamond (Median Ridged) cross section 710, and a Flattened Cross section 712.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

Having thus described several embodiments for practicing the inventive method, its advantages and objectives can be easily understood. Variations from the description above may and can be made by one skilled in the art without departing from the scope of the invention.

Accordingly, this invention is not to be limited by the embodiments as described, which are given by way of example only and not by way of limitation.

The invention claimed is:

1. An anchor for improved temporary anchoring of a beach umbrella, comprising:

a base including a frame having a top surface and a bottom surface, wherein the frame has an internal opening within the frame;

a wedge affixed to the bottom surface of the base at its proximal end, the wedge having a pointed end or rounded end at its distal end;

a base plate affixed to the base within the internal opening of the frame, the base plate having an opening for inserting or attaching the beach umbrella therethrough;

wherein the wedge is configured to be inserted and secured into a semi-solid surface; and wherein the beach umbrella is configured to be inserted or attached through the base plate opening and secured into the semi-solid surface; thereby providing constructive surface area communication and tension between the semi-solid surface and beach umbrella.

2. The anchor of claim 1, wherein the semi-solid surface comprises, sand, dirt, clay, soil, rocks, pebbles, grit, gravel, or a combination thereof.

3. The anchor of claim 1, wherein the base plate does not completely fill the internal opening of the frame.

4. The anchor of claim 1, wherein the base plate opening for inserting the beach umbrella further comprises a grommet for securely fitting said beach umbrella.

5. The anchor of claim 1, wherein the wedge is comprised of two tapered edges converging substantially to a point.

6. The anchor of claim 1, wherein the anchor is made of a material selected from a group consisting of metal, steel, aluminum, plastic, silicon, rubber, wood, stone, or a combination thereof.

7. The anchor of claim 1, wherein the wedge is positioned off center to allow a downward force to be exerted onto the wedge while a mast or pole is inserted or attached to the opening of the base plate.

8. The anchor of claim 1, wherein the anchor has gaps to allow flow of sand, water or other debris to pass through.

9. A method for installing a mast or pole anchor, comprising:

placing the anchor of claim 1 on a surface;

exerting a downward force onto said base; and plunging said wedge into said surface.

10. The method of claim 9, wherein the surface is sand, dirt, soil, rocks, pebbles, grit or a combination thereof.

11. The method of claim 9, wherein exerting said downward force is done by using body weight.

12. The method of claim 9, wherein exerting said downward force is configured to be done by using one's foot.

13. The method of claim 9, wherein exerting said downward force on said base is accomplished by applying pressure on said base to shift a center of gravity so as to increase a weight on said base.

14. The method of claim 9, further comprising positioning the pressure off center so as to avoid a space or the opening for the mast or pole.

15. The method of claim 9, further comprising inserting or attaching the mast or pole into a space or the opening.

16. The method of claim 9, wherein the step of plunging said wedge into said surface includes the use of a circular motion.

17. The method of claim 9, wherein the step of exerting the downward force onto said base includes the use of a circular motion.

18. The method of claim 9, wherein the beach umbrella is placed in the anchor prior to plunging said wedge into said surface.

19. The anchor of claim 1, wherein the frame includes flanged edges.

20. The anchor of claim 1, wherein the wedge has a beveled edge.

* * * * *